United States Patent [19]

Duguet

[11] Patent Number: 4,566,921

[45] Date of Patent: Jan. 28, 1986

[54] PRIMING COMPOSITION WHICH IS SENSITIVE TO PERCUSSION AND A METHOD FOR PREPARING IT

[75] Inventor: Jean Duguet, Tarbes, France

[73] Assignee: ETAT Francais Represente, Parl Le Delegue pour L'Armement, France

[21] Appl. No.: 699,472

[22] Filed: Feb. 8, 1985

[51] Int. Cl.[4] ..... C06B 43/00

[52] U.S. Cl. ..... 149/22; 149/23; 149/38; 149/40; 149/41; 149/42; 149/43; 149/44; 149/45; 149/77; 149/78; 149/83; 149/85

[58] Field of Search ..... 149/23, 22, 38, 40, 149/41, 42, 43, 44, 45, 77, 78, 83, 85

[56] References Cited

U.S. PATENT DOCUMENTS

| | | | |
|---|---|---|---|
| 3,965,951 | 6/1976 | Scott et al. | 149/23 |
| 4,024,818 | 5/1977 | Scott et al. | 149/23 X |
| 4,078,953 | 3/1978 | Sayles | 149/20 X |
| 4,078,954 | 3/1978 | Bernardy | 149/19.8 |
| 4,247,494 | 1/1981 | Carter | 149/24 X |
| 4,369,079 | 1/1983 | Shaw | 149/2 |
| 4,370,181 | 1/1983 | Lundstrom et al. | 149/2 |

*Primary Examiner*—Stephen J. Lechert, Jr.
*Attorney, Agent, or Firm*—Parkhurst & Oliff

[57] ABSTRACT

A priming composition with an elevated thermal stability, which is sensitive to percussion, is disclosed. The priming composition comprises a tetrazolic ring containing primary explosive and a sensitivity additive. The sensitivity additive comprises an oxidizing agent and a reducing agent. 40 to 95 weight percent of the priming composition is the primary explosive, 2.5 to 40 weight percent of the priming composition is the oxidizing agent and 2.5 to 40 weight percent of the priming composition is the reducing agent. The priming composition is applied to heads of percussion fuses.

10 Claims, No Drawings

PRIMING COMPOSITION WHICH IS SENSITIVE TO PERCUSSION AND A METHOD FOR PREPARING IT

BACKGROUND OF THE INVENTION

The present invention relates to initiator explosive compositions that are sensitive to percussion and are used, for example, to equip the heads of percussion fuses.

The heads of percussion fuses, used to assure the initiation of delayed or instantaneous deflagrating or detonating relays, comprise an initiating or priming composition which is sensitive to the penetration of a striker nose having a more or less sharp-pointed tip. Under the effect of percussion, the initiating or priming composition breaks up by detonating or deflagrating very rapidly in accordance with the nature of the explosive used.

Priming compositions exist in closely related forms and belong to two distinct families. The first family includes compositions that do not have a priming force and, hence, serve to initiate a delay, or compositions that initiate detonation, provided that a priming element usually consisting of lead nitride is joined to the composition. The second family includes compositions that have a sufficient priming force to initiate directly the detonation of a relay without the necessity of an intermediate composition.

The first family includes compositions based on basic lead styphnate known as "NOL 130" in the United States, on lead dinitroresorcinate known as "L mixture" or RD 1651 in Great Britain, or on lead thiocyanate as used in France.

The second family includes compositions based on primary explosives, such as lead nitride with the addition of tetrazene, particularly used in France.

In all cases these compositions are very sensitive and have a drawback in that they do not tolerate stockpiling at an average temperature above 75° C. for periods longer than several days. Also, they do not tolerate temperature peaks on the order of 100° to 120° C. for periods longer than several hours. These conditions frequently exist when storing or using ammunition equipped with these initiators. U.S. Pat. No. 3,634,155 and French Pat. No. 2,386,505 describe these conventional priming compositions.

French Pat. No. 2,309,493 describes a process for encasing primary explosives and mentions the possibility of preparing percussion powders from copper chlorotetrazolate, oxidizing agents and reducing agents. The essential idea of this patent, however, is to facilitate the handling of primary explosives by encasing them with a binder. Moreover, no priming composition is disclosed.

Recently it was described in the Journal ERDE 1975 (Conference on Research in Primary Explosives) that a mercuric salt of 5-nitrotetrazole could replace lead nitride in priming compositions. It is a theoretical study, however, which does not propose any priming composition.

Priming compositions for initiating detonation are characterized by their sensitivity to percussion, their thermal stability and their power to fire a secondary explosive. Conventional compositions based on tetrazene have an excellent sensitivity to percussion and an excellent priming force, but have a drawback in that these properties are altered by heat. Conventional compositions based on lead thiocyanate have an excellent sensitivity to percussion which is not altered by heat, but they do not possess a priming force. Instead, they require the introduction into the pyrotechnical chain of an element usually consisting of lead nitride.

SUMMARY OF THE INVENTION

The object of the present invention is to provide a priming composition that is very sensitive to percussion, at least as sensitive as the conventional compositions mentioned above, but whose properties are preserved under harsh environmental conditions.

Therefore, the object of the invention is to provide a priming composition with elevated thermal stability, which is highly sensitive to percussion. The priming composition comprises a tetrazolic ring containing primary explosive and a sensitivity additive. The sensitivity additive comprises an oxidizing agent and a reducing agent. 40 to 95 weight percent of the priming composition is the primary explosive, 2.5 to 40 weight percent of the priming composition is the oxidizing agent and 2.5 to 40 weight percent of the priming composition is the reducing agent.

DETAILED DESCRIPTION OF THE DISCLOSURE

The primary explosive can be represented by 5-nitrotetrazole, mercuric or silver salts of 5-nitrotetrazole, neutral or basic silver or lead azotetrazole, halogenated tetrazoles and their salts, or a mixture thereof.

The oxidizing agent can be represented by potassium or sodium chlorate; potassium or sodium perchlorate; calcium, strontium or barium nitrate; lead or manganese dioxide; potassium permanganate; sodium or potassium dichromate; or a mixture thereof. The reducing agent can be represented by antimony sulfide, lead thiocyanate, titanium, zirconium, boron, or a mixture thereof.

Preferably, the priming composition of the present invention comprises:

40 to 80 weight percent of a mercuric salt of 5-nitrotetrazole,
10 to 35 weight percent potassium chlorate,
5 to 18 weight percent lead thiocyanate, and
3 to 12 weight percent antimony sulfide.

The composition of the present invention has excellent thermostability properties while preserving its sensitivity to percussion even after an extended period under harsh environmental conditions.

Also, the priming composition of the present invention predominantly generates a shock wave likely to prime the charge of a projectile, such as a high-explosive shell provided with a percussion fuse, or a hollow-charge shell.

The preparation of a priming composition in accordance with the present invention does not present any particular difficulties. Compounds available in the trade are employed. The primary explosive is available in the form of a fine powder preferably sifted into a granular size fraction of about 0.2 mm. As a preparation guide, one can proceed as follows:

The primary explosive, the reducing agent, and the oxidizing agent are dried and sifted and are then introduced one after the other in no particular order, into a rotary mixer that is used for pyrotechnical compositions and is provided with necessary safety devices.

Following suitable homogenization, a specific charge of the mixture obtained is introduced by a manual or mechanical, single or multiple, process into recesses of stainless steel miniature detonators having an internal diameter of about 3.8 mm, after which a sealing disk of paper or plastic fiber is placed on the charge, and each charge is compressed with a force of about 300 daN.

The prepared detonators can be initiated by percussion through the sealing disk by means of a steel tip having a truncated end.

The following examples are provided to further illustrate the priming composition of the present invention. These examples are merely illustrative of the present invention and are not intended to be limiting thereto.

EXAMPLE 1

A first series of primers incorporating the present invention and having the following composition:

75 weight percent of a mercuric salt of 5-nitrotetrazole,
14 weight percent of potassium chlorate,
7 weight percent of lead thiocyanate,
4 weight percent of antimony sulfide was prepared according to the above-identified process.

In a similar manner, a second series of initiators containing a conventional priming composition of 95 weight percent lead nitride and 5 weight percent tetrazene was prepared.

These two series of primers were then subjected to three tests, as follows:

1. ordinary storage for 15 days at an ambient temperature of about 20° C.;
2. isothermal storage for 15 days at 75° C.;
3. tests of ten 36-hour climatic cycles including 12 hours at 74° C. then raising the temperature to 100° C. in 2 hours and maintaining this temperature for 4 hours, then decreasing the temperature to −54° C. in 1 hour and maintaining this temperature for 14 hours, then raising the temperature to 74° C. in 3 hours.

The six groups of priming compositions were then tested by firing on a drop hammer with initiation by a truncated striker propelled by a 3.2 g ball falling from a variable height according to Bruceton's sequential method, which enables the sensitivity to percussion to be determined. The equipment additionally included a base that permits the evaluation of the priming force by detonation behind a variable aluminum barrier of a 50 mg charge of pentrite (pentaerythritol tetranitrate) whose power is examined by the penetration or non-penetration of a 2 mm thick steel reference plate.

The results obtained are shown in the table below by the height of fall with a 0.5 probability of explosion for sensitivity and by the maximum thickness of the aluminum barrier for the priming force relative to pentrite.

| | Primer of the Present Invention | | Conventional Primer | |
|---|---|---|---|---|
| | Sensitivity (height in mm) | Priming force (thickness in mm) | Sensitivity (height in mm) | Priming force: (thickness in mm) |
| usual storage | 135 | 1.0 | 150 | 0.6 |
| storage at 75° C. for 15 days | 146 | 0.6 | 600 | 0.4 |
| 10 climatic cycles | 145 | 0.8 | 250 | 0.5 |

The results shown in this table indicate that the sensitivity and power characteristics of the primer of the present invention are virtually preserved after each of the tests, while the characteristics of the conventional primers deteriorate seriously, especially in their sensitivity to percussion.

EXAMPLE 2

A third series of primers of the present invention having a composition shown below were prepared in accordance with the process described above:

50 weight percent of a mercuric salt of 5-nitrotetrazole,
29 weight percent of potassium chlorate,
14 weight percent of lead thiocyanate, and
7 weight percent of antimony sulfide.

In a similar manner, a fourth series of conventional primers, consisting of:

25 weight percent lead thiocyanate,
13 weight percent antimony sulfide,
52 weight percent potassium chlorate, and
10 weight percent pentrite (PETN)

were prepared as a reference.

These two series of primer compositions were subjected to the three tests described in Example 1 above, with the sensitivity results being measured in a similar manner. The results are shown in the following table (values in mm):

| Test after: | Primer of the present invention (series 3): | Conventional reference primer (series 4): |
|---|---|---|
| usual storage | 130 | 150 |
| storage at 75° C. for 15 days | 100 | 220 |
| 10 climatic cycles | 105 | 450 |

It will be noted that the primers of the present invention produce, in a very short time, a deflagration similar to that required at the start of certain pyrotechnical chains, such as, for example, those with a brief delay. They possess an excellent sensitivity to percussion, which is slightly modified after each test, unlike conventional primers that provide very scattered results.

While the present invention has been described in detail and with reference to specific examples thereof, it will be apparent to one skilled in the art that various changes and modifications can be made therein without departing from the spirit and scope thereof.

I claim:

1. A percussion-sensitive priming composition with an elevated thermal stability comprising:

a primary explosive having a tetrazolic ring, and
a sensitivity additive, said sensitivity additive comprising an oxidizing agent and a reducing agent;
wherein said primary explosive comprises 40 to 95 weight percent of said priming composition, said oxidizing agent comprises 2.5 to 40 weight percent of said priming composition and said reducing agent comprises 2.5 to 40 weight percent of said priming composition.

2. The composition of claim 1, wherein said primary explosive is selected from the group consisting of 5-nitrotetrazole, a mercuric or silver salt of 5-nitrotetrazole, neutral or basic silver- or lead- azotetrazole, halogenated tetrazoles and their salts, and a mixture thereof.

3. The composition of claim 1, wherein said oxidizing agent is selected from the group consisting of potassium or sodium chlorate; potassium or sodium perchlorate;

calcium, strontium or barium nitrate; lead or manganese dioxide; sodium or potassium permanganate; sodium or potassium dichromate; or a mixture thereof; and wherein said reducing agent is selected from the group consisting of antimony sulfide, lead thiocyanate, titanium, zirconium, boron and a mixture thereof.

4. The composition of claim 2, wherein said oxidizing agent is selected from the group consisting of potassium or sodium chlorate; potassium or sodium perchlorate; calcium, strontium or barium nitrate; lead or manganese dioxide; sodium or potassium permanganate; sodium or potassium dichromate; and a mixture thereof; and wherein said reducing agent is selected from the group consisting of antimony sulfide, lead thiocyanate, titanium, zirconium, boron and a mixture thereof.

5. The composition of claim 3, comprising:

40 to 80 weight percent of a mercuric salt of 5-nitrotetrazole, 10 to 35 weight percent of potassium chlorate, 5 to 18 weight percent of lead thiocyanate, and 3 to 12 weight percent of antimony sulfide.

6. The composition of claim 4, comprising:

40 to 80 weight percent of a mercuric salt of 5-nitrotetrazole, 10 to 35 weight percent of potassium chlorate, 5 to 18 weight percent of lead thiocyanate, and 3 to 12 weight percent of antimony sulfide.

7. The composition of claim 5, comprising:

75 weight percent of a mercuric salt of 5-nitrotetrazole, 14 weight percent of potassium chlorate, 7 weight percent of lead thiocyanate, and 4 weight percent of antimony sulfide.

8. The composition of claim 6, comprising:

75 weight percent of a mercuric salt of 5-nitrotetrazole, 14 weight percent of potassium chlorate, 7 weight percent of lead thiocyanate, and 4 weight percent of antimony sulfide.

9. The composition of claim 5, comprising:

50 weight percent of a mercuric salt of 5-nitrotetrazole, 29 weight percent of potassium chlorate, 14 weight percent of lead thiocyanate, and 7 weight percent of antimony sulfide.

10. The composition of claim 5, comprising:

50 weight percent of a mercuric salt of 5-nitrotetrazole, 29 weight percent of potasium chlorate, 14 weight percent of lead thiocyanate, and 7 weight percent of antimony sulfide.

* * * * *